United States Patent [19]

Stepanek

[11] 4,313,575

[45] Feb. 2, 1982

[54] CAPS FOR HAMMERMILL ROTORS SECURED BY INDIVIDUALLY-REMOVABLE PAIRED PIN ASSEMBLIES

[75] Inventor: Robert M. Stepanek, Cedar Rapids, Iowa

[73] Assignee: Pettibone Corporation, Chicago, Ill.

[21] Appl. No.: 40,977

[22] Filed: May 21, 1979

Related U.S. Application Data

[63] Continuation-in-part of Ser. No. 883,054, Mar. 3, 1978, abandoned.

[51] Int. Cl.[3] ..... B02C 13/16

[52] U.S. Cl. ..... 241/194; 241/197

[58] Field of Search ..... 241/189 R, 189 A, 194, 241/197

[56] References Cited

U.S. PATENT DOCUMENTS

| | | | |
|---|---|---|---|
| 1,940,116 | 12/1933 | Brooks | 241/197 |
| 2,133,212 | 10/1938 | Schutte et al. | 241/197 |
| 3,510,076 | 5/1970 | Perdue | 241/197 |
| 3,727,848 | 4/1973 | Francis | 241/197 X |
| 3,844,494 | 10/1974 | Hightower | 241/197 |
| 4,046,327 | 9/1977 | Cranor | 241/197 |

*Primary Examiner*—Howard N. Goldberg
*Attorney, Agent, or Firm*—Louis Robertson

[57] ABSTRACT

Leading edges of rotor-plates which carry the swing hammers of hammermills are protected from wear by removable caps, each secured by paired pin assemblies, each of which may be shifted axially to permit removal of the cap it normally secures. Each pin assembly includes a pair of tubular pins or pin portions which may be axially abutting one another, each assembly including at least one portion which is short enough to be removed (or moved axially to a position which permits removal of the cap). In the original form of the parent application, each assembly was totally countersunk within the cap, having heads at each end that were countersunk and having in each head the countersunk head or nut of a tie-bolt. In the form preferred at the time of filing this continuation-in-part application, the pair of tubular pivots forming each assembly is held in place by reliable friction resulting from the expanding force of split-spring-tubes forcefully squeezed substantially closed during insertion. Either form lies entirely within the side faces of the cap where a hammer swings adjacent to the cap so as not to interfere with the swing of the hammer. With both forms, the caps can be replaced without removing the rotor from the hammermill, and without removing the hammerbolt that holds the hammers (unless that hammerbolt extends directly through the side walls of the caps, as may be the case in some instances).

12 Claims, 8 Drawing Figures

CAPS FOR HAMMERMILL ROTORS SECURED BY INDIVIDUALLY-REMOVABLE PAIRED PIN ASSEMBLIES

This application is a continuation-in-part of application Ser. No. 883,054 filed Mar. 3, 1978 and being abandoned in favor of this application.

INTRODUCTION

The invention of which the present disclosure is offered for public dissemination in the event adequate patent protection is available relates to hammermills of the swinghammer type. One use for hammermills, for which the present invention is especially suitable, is for shredding automobile bodies and the like. In such hammermills, the hammers are part of a rotor which is driven at high speed by its shaft. Each shaft carries a series of hammer-holding discs or plates (which could also be called spiders). A hammerbolt extends parallel to the shaft through a row of spaced spider arms provided by said plates, with a swing hammer carried by the hammerbolt in the space between each adjacent pair of arms in the row. As the hammers smash the material fed to the hammermill, fragments or shreds fly about or remain, and the rotating arms inevitably strike some of these pieces and are abraded by them so that eventually, if not protected, they become so worn that they must be replaced.

Replacing the plates, discs, or spiders which form these arms is very expensive, both as to parts cost and as to labor. For a number of years it has been recognized that a great saving can be accomplished by replaceable caps over the leading edges of these rotating arms so that nearly all of the wear which would otherwise be on the arms themselves is on these caps. When worn to the extent that they may seen fail to protect the arms, they may be replaced.

An example of such caps is Francis U.S. Pat. No. 3,727,848, in which the spider arms are specially shaped with deep central grooves in them to receive inwardly extending central flanges on the caps, with the hammerbolts passing through these flanges to hold the caps in place. Although widely used, this has had some recognized disadvantages including the fact that the caps could not be replaced without drawing a hammerbolt. This would, of course, release the hammers.

Another example was Hightower U.S. Pat. No. 3,844,494. In this construction, also, caps could only be replaced by withdrawing the hammerbolt which would release all of the hammers.

Prior to these patented constructions, the owner of the present application had protected the rotor arms with caps which were secured in place partly by welding. However, these caps were also secured in place partly by the hammerbolts, and hence could not be removed without withdrawing the hammerbolt and thereby releasing all of its hammers.

The owner of this application has more recently protected the rotor arms by caps which could be removed without removing the hammerbolts. However, these caps were secured by long bolts similar to the hammerbolts which had to be withdrawn in similar manner. Each cap-securing bar extended axially the full length of the rotor. A recognized disadvantage of this construction was that the swinging of the hammers was limited. A hammer could not swing through a full circle, because it would strike the bolt which extended through the arms the full length of the rotor to secure the caps.

According to the present invention these various disadvantages are avoided. Each cap can be removed separately, and the hammers are not impeded by the cap-securing means from full-circle swinging. Various discouraging considerations were overcome by providing countersunk pin assemblies which, in spite of limited clearances, could be removed. Each pin assembly includes two aligned sturdy flat-ended tubular extending through the interfaces between the caps and the arms to absorb such impacts as may result from their relative movement. These two sturdy outer pins can be held substantially by an inner bolt fully countersunk in the outer bolts, which in turn are fully countersunk within the faces of the sides of the caps, or by spring-induced friction.

The advantages of the invention will be more easily understood in the light of the description and the drawings.

DESIGNATION OF FIGURES

Figure 5:
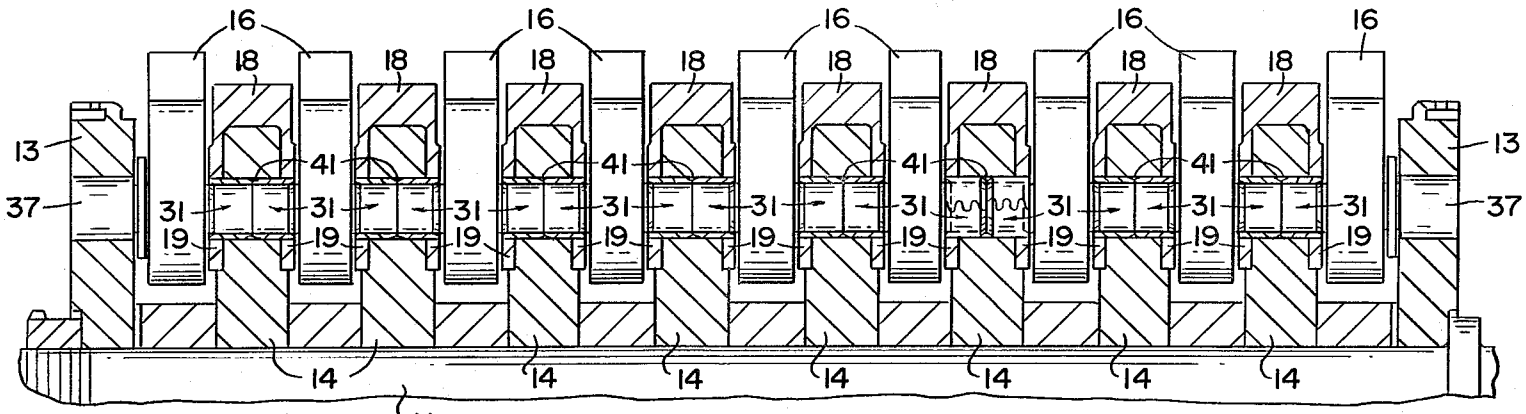
Figure 8:
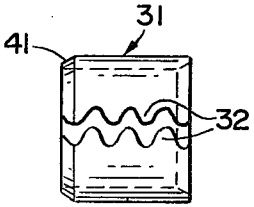
Figure 7:
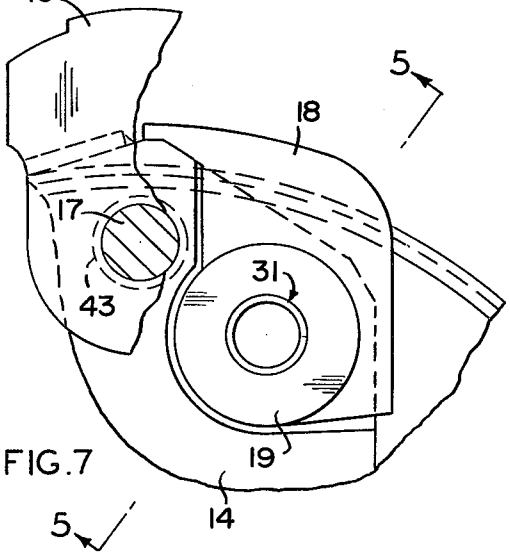
Figure 6:
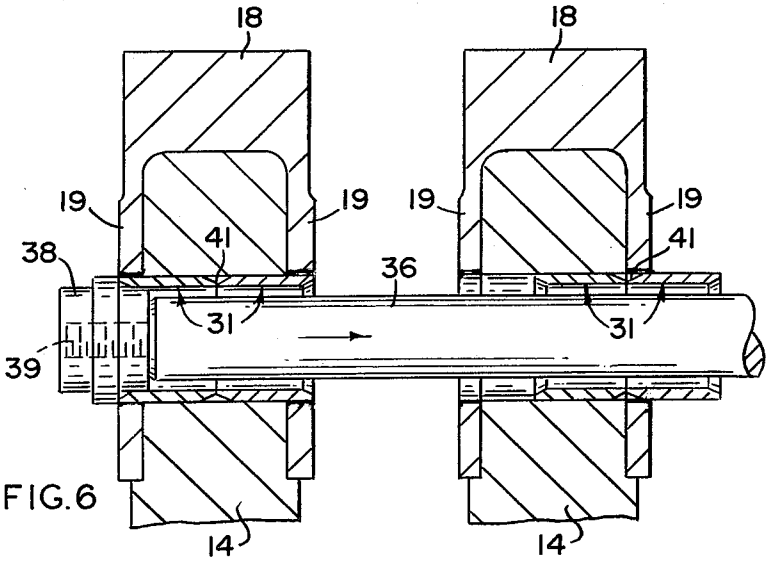

FIGS. 5 to 8 show a modification preferred at the time of filing this continuation-in-part application. FIG. 5 is an axial sectional view with a variation to show the side surface of one pin assembly. FIG. 6 is a fragmentary detail illustrating a preferred method of removal. FIG. 7 is a fragmentary view similar to a part of FIG. 2, except of the modification. FIG. 8 is a side view of one split tubular spring pin in its relaxed condition.

BACKGROUND DESCRIPTION

Figure 2:
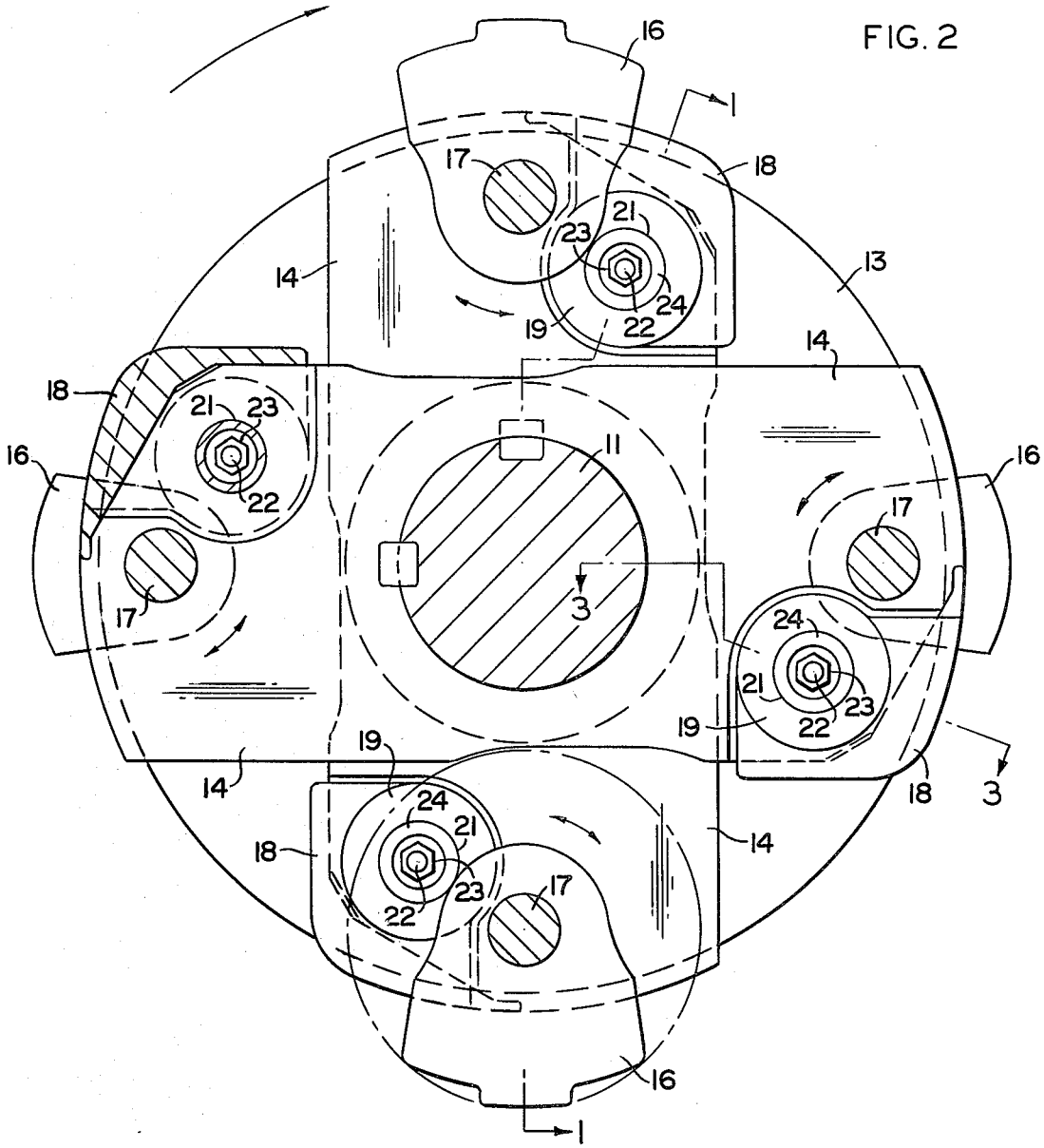
FIG. 2 is a radial sectional view through the rotor of FIG. 1, taken approximately along the line 2—2 of FIG. 1.

Rotors such as that of this invention conventionally include a drive shaft 11, which may run in bearing assemblies 12, carried by a housing or support not shown. The working part of the rotor includes two end discs 13, between which are compactly arranged hammer-carrying rotor plates, sometimes called "spiders", such as the generally rectangular rotor plates 14 shown in horizontal disposition in FIG. 2. In FIG. 2 the rotor plates 14 are seen to be arranged in crossing directions.

Figure 1:
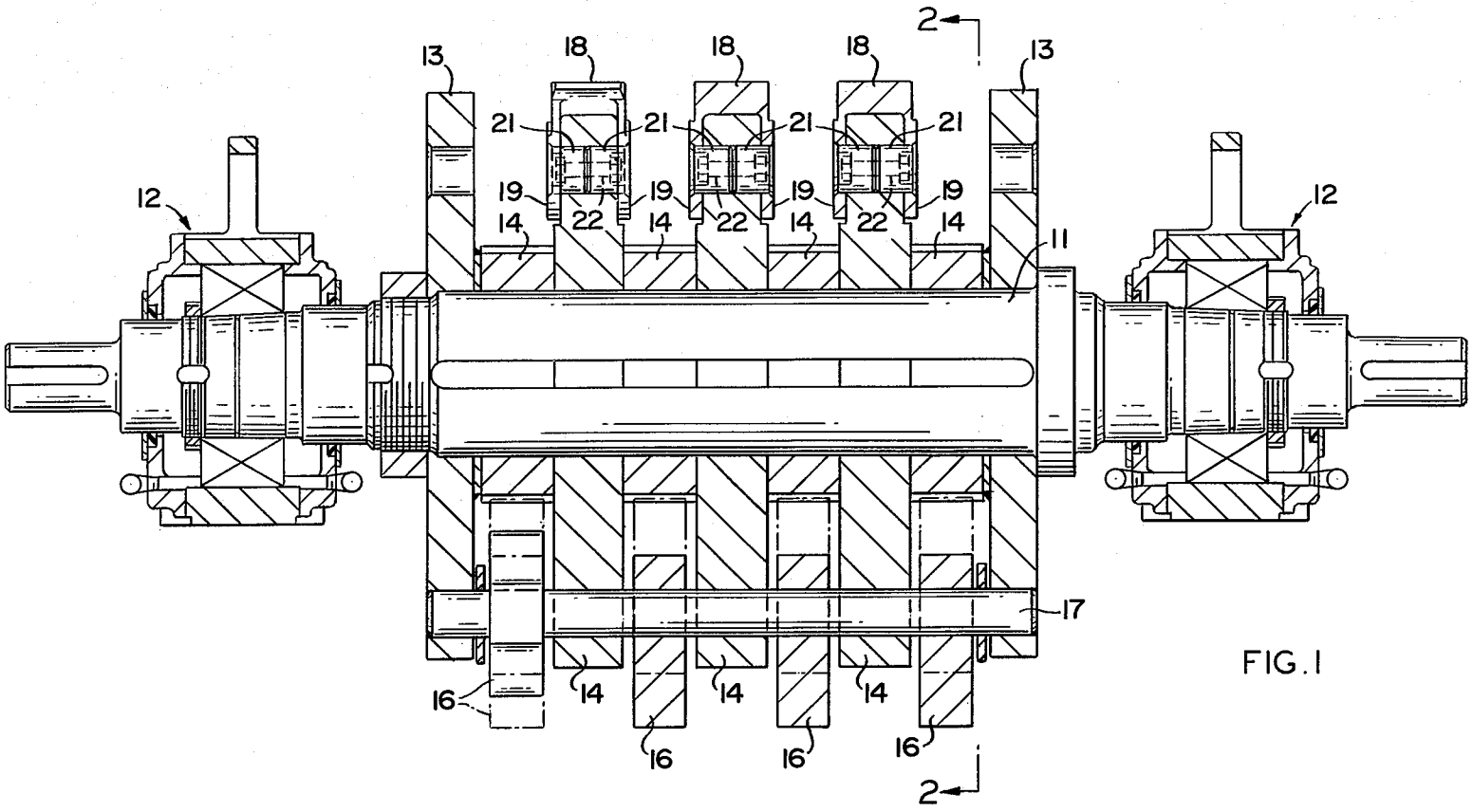
FIG. 1 is a sectional view through a rotor of this invention, taken approximately along the irregular line 1—1 of FIG. 2.

As seen best in FIG. 1, the crossed dispositions of the rotor plates 14 leave hammer-receiving spaces between the projecting end portions of the rotor plates 14. Along each row of projecting end portions, a row of swing hammers 16 is located. That some of these hammers are seen in FIG. 1 to be different from each other has no pertinence to the present invention. The hammers 16 of each row are carried by a hammerbolt 17. It is conventional to be able to withdraw a hammerbolt 17 by axial movement in either direction, so that the hammers 16 can be replaced when they have become badly worn.

DESCRIPTION OF THE ORIGINAL FORM OF THE PRESENT INVENTION

The present invention is particularly concerned with protective caps 18, which, as best seen in FIG. 2, at the left side, protect the leading edges of the rotor plates 14. Caps for this purpose have been provided heretofore. According to the present invention, the caps 18 have side portions 19 by which the caps are secured by pin assemblies passing through each cap and the rotor-plate arm which it protects.

Figure 3:
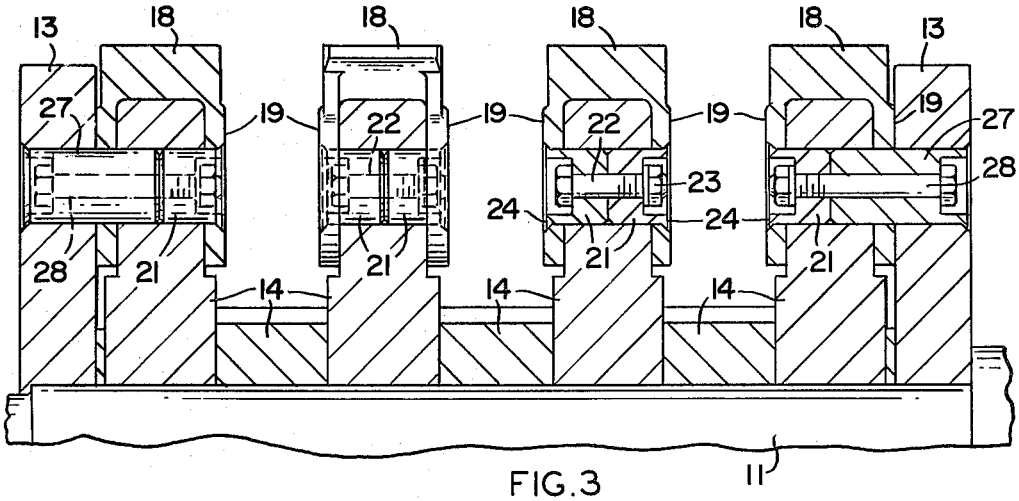
FIG. 3 is a fragmentary sectional view taken approximately along the line 3—3 of FIG. 2, being irregular, but approximately 90° displaced from the upper portion of FIG. 1.

A typical pin assembly of the form preferred at the time the parent application was filed can be described with reference to the second cap 18 from the right in FIG. 3. In FIG. 3, a pair of tubular pins 21 in abutting relationship jointly form a pin passing through the associated cap 18 and its rotor-plate 14. The pair of tubular pins is held together by a tiebolt 22 and its nut 23. The pin assemblies for the rightmost and leftmost caps 18 in FIG. 3 are varied to the extent that in addition to one pin 21, there is a longer pin 27, also tubular, for extending through the end disc 13 to be accessible from the outside of the housing. Also, a longer bolt 28 is used. Because it is inserted from the outside, it does not need to be as short as bolts 22 in order to be removed. The bolts 22 may look too long to be removed, but they can be "snaked" in and out, partly because of the countersinking for receiving their heads.

Figure 4:
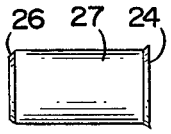
FIG. 4 is a side view of one of the longer pins, showing it aligned with FIG. 3 as if just removed therefrom.

Each pin 21 and 27 has a head 24 which is best seen in FIG. 4, where it is shown on pin 27. This may be described as a conical-flat head. In other words, its face toward the body of its pin (27 in FIG. 4) is of conical shape, while its end face lies in a flat plane. The small end of pin 21 and 27 has a taper 26 to ease its insertion.

REMOVAL OF PIN ASSEMBLIES TO REPLACE CAPS

With the form of the invention shown in FIGS. 1 to 4, the caps are removed by removing the pin assemblies, piece by piece. Although often the caps will be replaced all at once, a single one could be replaced if it should be more worn than others. The end caps in FIG. 3 can be removed most easily, inasmuch as the bolt 28 can be withdrawn axially after its nut 23 is removed. In the case of the other caps 18, the removal is almost as easy inasmuch as the shorter bolts 22 can be withdrawn axially until they can be tilted readily (by virtue of the fact that they only extend into the large countersinking hole which has received the head of the bolt). The short pins 21 are short enough so that when removed axially, they can, without being tilted, be moved radially between the sides of the caps. When both pins of a pair have been removed, the cap 18 can be slipped off, a new cap substituted, the pins 21 worked back into the position shown in FIG. 3 and be secured there by a bolt 22 and its nut 23. Of course, any damaged pin would be replaced by a corresponding part.

It is preferred that the pins 21 be long enough so that they will abut together while still having some appreciable end-play, as this will facilitate removal. The end-play may permit a tool to be inserted under one head 24 for prying the pin out. Optionally, or when necessary, a hammer blow on the head of one pin will usually knock the other pin loose or even completely out. The heads are enough thinner than the recesses for receiving the heads so that with maximum end-play the head will not protrude beyond the outer radial face of the cap. The countersinking recesses in the end of the pins are oversize around the bolt head or nut to receive a socket wrench or ring wrench for screwing the nut on the bolt. One end could be held by the parts, the wrench-receiving space being provided only at the other end.

SPLIT-SPRING TUBULAR PINS NOW PREFERRED

FIGS. 5 to 8 show a simplified form of the invention which has been found to work as well as that described above. This form uses split-spring tubular tubular pins 31, one of which is shown in FIG. 8 in its relaxed condition. In this condition its interfitting ends 32 are spread apart, as shown in FIG. 8. Each pin 31 is short enough axially to be inserted between two caps 18. They can then be compressed to bring their ends together and inserted, one from each side, into their pinning positions shown in FIG. 5, and at the left in FIG. 6. In FIG. 5, one of these inserted pairs of pins 31 has been shown in side elevation, with its interfitting ends seemingly in contact. Actually, they are more likely to be minutely separated, because manufacturing tolerances would have to be too close if they were all to fit so perfectly that their ends would be in firm contact.

Having, as stated, been compressed from the ends-apart condition of FIG. 8 to the substantially closed position shown (third from the right) in FIG. 5, it is apparent that the split pins 31 in FIG. 5 are in compressed condition. The compressive strength of the pins (their tendency to expand back to the FIG. 8 condition) holds them reliably secure in their pinning position during operation of the rotor. From mention of the hydraulicly actuated pull rod (next paragraph) it can be understood that the mentioned compressive strength produces high friction between the pins and their plate 14 which holds the pins in place. No heads are needed on the pins thus held. The caps do not need them for holding against axial movement because (as seen in FIGS. 1, 3 and 6) they are saddle shaped, with the side walls 19 close to the plates on opposite sides so that any axial movement is negligible.

FIG. 6 illustrates one preferred manner of removal of the caps 18. A hydraulicly actuated pull rod 36 is inserted through an apperture 37 in an end disc 13. After its end has passed through a cap to be prepared for removal to the relative position shown, a plug 38 is attached, as by threading it onto a screw-threaded stud 39 extending from the end of pull rod 36. Pull rod 36 is then actuated (toward the right from the FIG. 6 position) to slide the two tubular pins 31 until their cleavage plane is aligned with, or approaches, the cleavage between the side wall 19 and rotor-plate 14. The accuracy of alignment seen at the right in FIG. 6 is not required. The abutting ends of pins 31 are chamfered as seen at 41 in FIG. 8, and the holes through side walls 19 are oversize so that pin 31 is quite loose therein as soon as it is free from rotor plate 14. This occurs before the trailing pin 31 reaches the plane of the side wall of rotor-plate 14. When plug 38 has been removed by hand and pull rod 36 has been withdrawn from the cap thus prepared, the freed pin 31 can be lifted out by hand and the cap 18 removed. From the drawings, it is apparent that this entire operation may be performed in succession for each of the caps to be removed. For initial assembly, it will probably be preferred that one pin 31 be inserted in all of the arms of rotor-plates 14 before assembly of the rotor. Obviously, the insertion requires compression of the pin, as by a hand tool or by being driven into its receiving hole with its chamfer 41 entering first. After the cap has been applied to an arm, the other pin 31 will be inserted by hand into its hole, and hydraulic actuator rod 36 will push both pins 31 to their pinning position seen at the left in FIG. 6, with neither projecting beyond side wall 19 or into the path of the swing hammer.

VARIATIONS

There may be numerous variations which would meet the primary requirement of a fully countersunk or non-protruding pin assembly made up of two pins or pin parts each short enough to make removal of the caps without disassembly of the entire rotor possible. One variation would be to have one of the pins threaded to the other so that in effect they form their own retaining bolt. The illustrated forms are preferred, however. Experience has shown that the spring tubular pins are reliable; and also that if the other illustrated form is chosen, there is almost never any difficulty in unscrewing its nut and removing its bolt. The split-spring pins are commercially available, having been used, presumably for a long time, as bushings. In fact they may be used desirably as bushings in the holes receiving hammerbolts 17, as illustrated by the broken line 43 in FIG. 7.

ACHIEVEMENT

From the foregoing it is seen that the rotor arms or spider arms are protected by caps which are readily removable whenever desired, without having to draw the hammerbolt or any similar bolt which would prevent the full circle swinging of the hammers that some purchasers of hammermills prefer. No expensive extra equipment is required. The pulling equipment used for the split-spring form of the invention is usually at hand anyway for pulling the hammerbolts, except that inexpensive fittings may need to be additionally provided. No such pulling equipment is needed for the other form of the invention illustrated.

Although the above disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

Suitable spring tubular pins are commercially available as spring bushings, for example the Connex Inc. chrome vanadium spring steel bushings hardened throughout to Rockwell C of 44 to 50. If others are chosen, care should be exercised to be sure that their expansion force after insertion is sufficient to secure the pin assemblies in pinning position with complete reliability.

I claim:

1. In a hammermill rotor including as environment for this improvement a row of spaced rotor arms, mounted on and rotatable by a drive shaft, swing hammers in the spaces between the arms within the row, a hammerbolt extending axially through the arms and hammers to swingably secure the hammers;

the improvement comprising caps positioned over the leading edges of the arms and having side portions extending inwardly along the side faces of the arms, said caps being secured by pin assemblies in the arms and side portions but not protruding beyond the side portions, thereby leaving the spaces between the side portions free for the swinging of the hammers; said pin assemblies including two aligned pins in one assembly separable at a cleavage plane located in the central zone of the capped arm while the pin assembly is in pinning position, and each of the aligned pins being movable from the pinning position to permit removal of the cap, and each pin assembly being reliably secure in its pinning position during operation of the rotor.

2. In a hammermill rotor including as environment for this improvement a row of spaced rotor arms, mounted on and rotatable by a drive shaft, swing hammers in the spaces between the arms within a row, a hammerbolt extending axially through the arms and hammers to swingably secure the hammers;

the improvement comprising caps positioned over the leading edges of the arms and having side portions extending inwardly along the side faces of the arms, said caps being secured by pin assemblies in the arms and side portions but not protruding beyond the side portions, thereby leaving the spaces between the side portions free for the swinging of the hammers; said pin assemblies including two aligned tubular pins in one assembly separable at a cleavage plane located in the central zone of the capped arm while the pin assembly is in pinning position, a tie bolt extending through the pins and normally holding them in the pinning position, said tie bolt being removable without disassembly the pinning position to permit removal of the cap; and said pins having heads countersunk in the side portions making each pin assembly reliably secure in its pinning position during operation of the rotor.

3. In a hammermill rotor including as environment for this improvement a row of spaced rotor arms, mounted on and rotatable by a drive shaft, swing hammers in the spaces between the arms within a row, a hammerbolt extending axially through the arms and hammers to swingably support the hammers;

the improvement comprising caps positioned over the leading edges of the arms and having side portions extending inwardly along the side faces of the arms, said caps being secured by pin assemblies in the arms and side portions, but not protruding beyond the side portions, thereby leaving the spaces between the side portions free for the swinging of the hammers; said pin assemblies including two aligned tubular pins in one assembly separable at a cleavage plane located in the central zone of the capped arm while the pin assembly is in pinning position, a tie bolt extending through the pins and normally holding them in the pinning position, said tie bolt being removable without disassembly of the rotor, and each of the aligned pins being then movable from the pinning position to permit removal of the cap; said pins having heads countersunk in the side portions making each pin assembly reliably secure in its pinning position during operation of the rotor; and each tie bolt having its head and nut countersunk in the pins.

4. The improvement in a hammermill rotor according to claim 1, 2 or 3 in which at least one of the pins of each of said pin assemblies is short enough to be removed from its pinning position through the space between the caps.

5. The improvement in a hammermill rotor according to claim 2 or 3 in which the total length of the two pins, when in abuttment is sufficient to provide slight endplay to facilitate removal.

6. In a hammermill rotor including as environment for this improvement a row of spaced rotor arms, mounted on and rotatable by a drive shaft, swing hammers in the spaces between the arms within the row, a hammerbolt extending axially through the arms and hammers to swingably secure the hammers;

the improvement comprising caps positioned over the leading edges of the arms and having side portions extending inwardly along the side faces of the arms, said caps being secured by split spring tubular pin assemblies in the arms and side portions and lying substantially therewithin, thereby leaving the spaces between the side portions substantially free for the swinging of the hammers; said pin assemblies in each arm lying between swing hammers including two aligned pins in one assembly separable at a cleavage plane located in the central zone of the capped arm while the pin assembly is in pinning position, and each of the aligned pins being movable from the pinning position to permit removal of the cap, and each pin assembly being reliably secure in its pinning position during operation of the rotor.

7. In a hammermill rotor including as environment for this improvement a row of spaced rotor arms, mounted on and rotatable by a drive shaft, swing hammers in the spaces between the arms within the row, a hammerbolt extending axially through the arms and hammers to swingably secure the hammers;

the improvement comprising caps positioned over the leading edges of the arms and having side portions extending inwardly along the side faces of the arms, said caps being secured by resiliently compressed tubular pin assemblies in the arms and side portions and lying substantially therewithin to leave the spaces between the side portions substantially free for the swinging of the hammers; said pin assemblies in each arm lying between swing hammers including two aligned pins in one assembly separable at a cleavage plane located in the central zone of the capped arm while the pin assembly is in pinning position, and each of the aligned pins being movable from the pinning position to permit removal of the cap, and the compressive strength of the pins holding them reliably secure in their pinning position during operation of the rotor.

8. The improvement in a hammermill rotor according to claim 6 or 7, in which one of the two pins of each of said pin assemblies is short enough to lie within the arm between the side portions of the cap, and the other is short enough to remain clear of the next cap when the two pins are moved axially to place the cleavage plane between them in the cleavage plane between the arm and its associated cap.

9. The improvement in a hammermill rotor according to claim 6 or claim 7, in which the two pins of each of said pin assemblies can be slid by a powered pusher to a position in which the cleavage plane between them nears the cleavage between the arm and its cap to permit removal of the cap, one of the pins being short enough to then lie entirely within the arm and the other pin being short enough to stand clear of the next cap.

10. The method of removing a cap in the improvement of a hammermill according to claim 9 in which a powered puller is passed through an assembly of the pins in the pinning position and is powered to pull the assembly to the stated position permitting removal of the cap.

11. The method of removing a cap in the improvement of a hammermill according to claim 9 in which a powered member is inserted into the rotor along the axis of the pin assemblies and slides a pin assembly to the position with its cleavage plane near the cleavage between the arm and its cap.

12. The improvement in a hammermill rotor according to claim 6 or claim 7, in which at least one of the pins is chamfered on its end abutting the other, and in which the two pins of a pin assembly can be pushed by a powered pusher to a position in which the chamfered pin is free from the arm and loose in the sidewall of the cap to permit removal of the cap, one of the pins being short enough to then lie entirely within the arm and the other pin being short enough to be removed from the rotor.

* * * * *

UNITED STATES PATENT AND TRADEMARK OFFICE

CERTIFICATE OF CORRECTION

PATENT NO. : 4,313,575

DATED : February 2, 1982

INVENTOR(S) : Robert M. Stepanek

It is certified that error appears in the above-identified patent and that said Letters Patent are hereby corrected as shown below:

In column 1, in the line in lineposition 37 "seen" is changed to "soon".

In column 2, tenth line down, after "tubular", the word "pins" is inserted.

In column 6, in the second line below the line index "30" (the 5th line from the bottom of claim 2) after "disassembly" insert:

"of the rotor, and each of the aligned pins being then movable from".

Signed and Sealed this

*Twenty-fifth* Day of *May 1982*

[SEAL]

*Attest:*

*Attesting Officer*

GERALD J. MOSSINGHOFF

*Commissioner of Patents and Trademarks*